US006230983B1

(12) United States Patent
Kasen

(10) Patent No.: US 6,230,983 B1
(45) Date of Patent: May 15, 2001

(54) ROTATING VALVE MEMBER AND FUEL INJECTOR USING SAME

(75) Inventor: Jon E. Kasen, East Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/500,386

(22) Filed: Feb. 8, 2000

(51) Int. Cl.[7] ..... F02M 47/02; F02M 51/00; B05B 1/30

(52) U.S. Cl. ..... 239/88; 239/585.1

(58) Field of Search ..... 239/88, 90, 91, 239/92, 93, 95, 574, 585.1; 251/59, 28

(56) References Cited

U.S. PATENT DOCUMENTS

| | | | | |
|---|---|---|---|---|
| 3,626,967 | | 12/1971 | McCarthy | 137/106 |
| 4,326,672 | | 4/1982 | Goloff | 239/91 |
| 4,440,134 | * | 4/1984 | Nakao et al. | 123/447 |
| 4,488,476 | | 12/1984 | Diel et al. | 91/513 |
| 4,658,824 | | 4/1987 | Scheibe | 123/472 |
| 4,962,887 | | 10/1990 | Matsuoka | 239/95 |
| 4,967,796 | | 11/1990 | Meyer | 137/624.15 |
| 5,058,625 | | 10/1991 | Kaiser et al. | 137/624.15 |
| 5,588,412 | | 12/1996 | Nozaki | 123/496 |
| 5,724,926 | * | 3/1998 | Wilke | 123/80 BA |
| 5,901,550 | * | 5/1999 | Bussing et al. | 60/39.38 |
| 6,050,496 | * | 4/2000 | Hefler | 239/88 |
| 6,050,497 | * | 4/2000 | Cotton | 239/88 |

* cited by examiner

*Primary Examiner*—David A. Scherbel
*Assistant Examiner*—Davis Hwu
(74) *Attorney, Agent, or Firm*—Michael B. McNeil

(57) ABSTRACT

A fuel injector comprises an injector body that defines a high pressure passage and a nozzle outlet. The injector body includes a nozzle valve member that is positioned between the high pressure passage and the nozzle outlet. The nozzle valve member is rotatable between a closed position in which the nozzle outlet is blocked and an open position in which the nozzle outlet is open.

19 Claims, 3 Drawing Sheets

ROTATING VALVE MEMBER AND FUEL INJECTOR USING SAME

TECHNICAL FIELD

The present invention relates generally to rotating nozzle valve members, and more particularly to hydraulically actuated fuel injectors having rotating nozzle valve members.

BACKGROUND ART

In almost all fuel injectors, fuel spray to the combustion chamber is initiated by the movement of a nozzle valve member along a vertical centerline to open the nozzle outlet. When the desired amount of fuel has been injected, the nozzle valve member returns to its biased position, closing the nozzle outlet and ending fuel spray. The force that moves the nozzle valve member to open and close the nozzle outlet may be hydraulic, mechanical, or a combination of the these forces. While these nozzle valve members have performed adequately, there is room for improvement of nozzle valve members.

Specifically, engineers are always searching for ways to improve fuel injector performance and to reduce the likelihood that internal fuel injector components will fail. For instance, in the fuel injectors discussed above, there is a possibility for the injector tip to fail due to impact of the nozzle valve member with the injector body. While the probability of such an event is low, if an injector tip fails, the metal fragments can destroy an entire engine. Therefore, it would be desirable to develop a nozzle valve member that performed as well or better than previous nozzle valve members, while opening and closing the nozzle outlet in a without significantly impacting the injector tip.

The present invention is directed to overcoming one or more of the problems set forth above.

DISCLOSURE OF THE INVENTION

A fuel injector comprises an injector body that defines a high pressure passage and a nozzle outlet. The injector body includes a nozzle valve member that is positioned between the high pressure passage and the nozzle outlet. The nozzle valve member is rotatable between a closed position in which the nozzle outlet is blocked and an open position in which the nozzle outlet is open.

BEST MODE OF CARRYING OUT THE INVENTION

Figure 1:
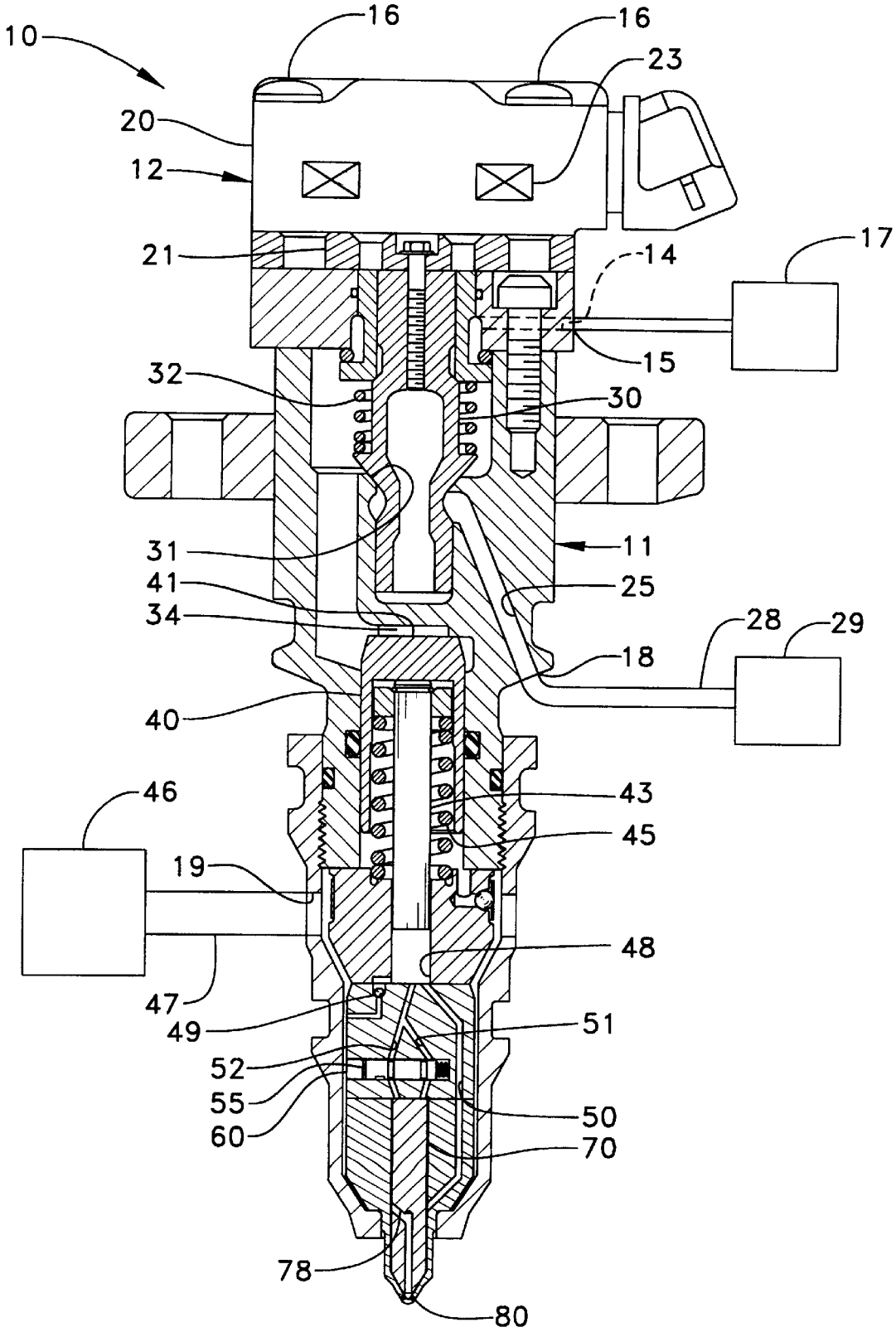
FIG. 1 is a diagrammatic representation of a hydraulically actuated fuel injector according to the present invention.

Referring now to FIG. 1 there is shown a diagrammatic representation of a hydraulically actuated fuel injector 10 according to the present invention. Fuel injector 10 includes an injector body 11 made up of various components that are attached to one another in a manner well known in the art and a substantial number of internal movable components positioned as they would be just prior to an injection event.

Actuation fluid, which is preferably high pressure oil, can flow into a high pressure actuation fluid passage 25 that is defined by injector body 11 via an actuation fluid inlet 18 and high pressure supply line 28 from the source of high pressure fluid 29. At the end of an injection event, actuation fluid can flow out of a low pressure passage 14 that is defined by injector body 11 via an actuation fluid drain 15 into low pressure fluid reservoir 17.

Fuel injector 10 is controlled in operation by a control valve 12 that includes an electrical actuator 20 which is preferably a solenoid, but could also be another suitable device such as a piezoelectric actuator. Control valve 12 is positioned on injector body 11 and attached by fasteners 16, which are preferably bolts but could be another suitable attachment device. Electrical actuator 20 includes a coil 23 and an armature 21 that is operably connected to a valve member 30. Valve member 30 is preferably a poppet valve member, however it should be appreciated that another valve members could be substituted, such as a spool valve member. When electrical actuator 20 is de-energized, a biasing spring 32 biases valve member 30 to close a high pressure valve seat 31. When valve member 30 is in this position, an actuation fluid cavity 34 is blocked from fluid communication with high pressure actuation fluid passage 25 and open to a low pressure drain 15 and a low pressure reservoir 17 via a low pressure drain 14. When electrical actuator 20 is energized, armature 21 pulls valve member 30 upward, opening valve seat 31 and fluidly connecting high pressure actuation fluid passage 25 with actuation fluid cavity 34.

A reciprocating pumping element, which includes piston 40 and a plunger 43, is movably positioned in injector body 11 and includes a hydraulic surface 41 that is exposed to fluid pressure in actuation fluid cavity 34. Piston 40 is biased toward an upward position by a return spring 45. Attached to piston 40 is plunger 43 that is also biased to an upward position by return spring 45. Piston 40 advances due to the hydraulic pressure force exerted on hydraulic surface 41 in actuation fluid cavity 34. When piston 40 begins to advance, plunger 43 advances in a corresponding manner and acts as the hydraulic means for pressurizing fuel within a fuel pressurization chamber 48 that is defined in part by injector body 11. Fuel pressurization chamber 48 is connected to a fuel inlet 19 past a ball check valve 49. Fuel inlet 19 is connected to a source of fuel 46 via a fuel supply passage 47. When plunger 43 is returning to its upward position, low pressure fuel is drawn into fuel pressurization chamber 48 past check valve 49. During an injection event as plunger 43 moves toward its downward position, check valve 49 is closed and plunger 43 can act to compress fuel within fuel pressurization chamber 48.

Figure 2:
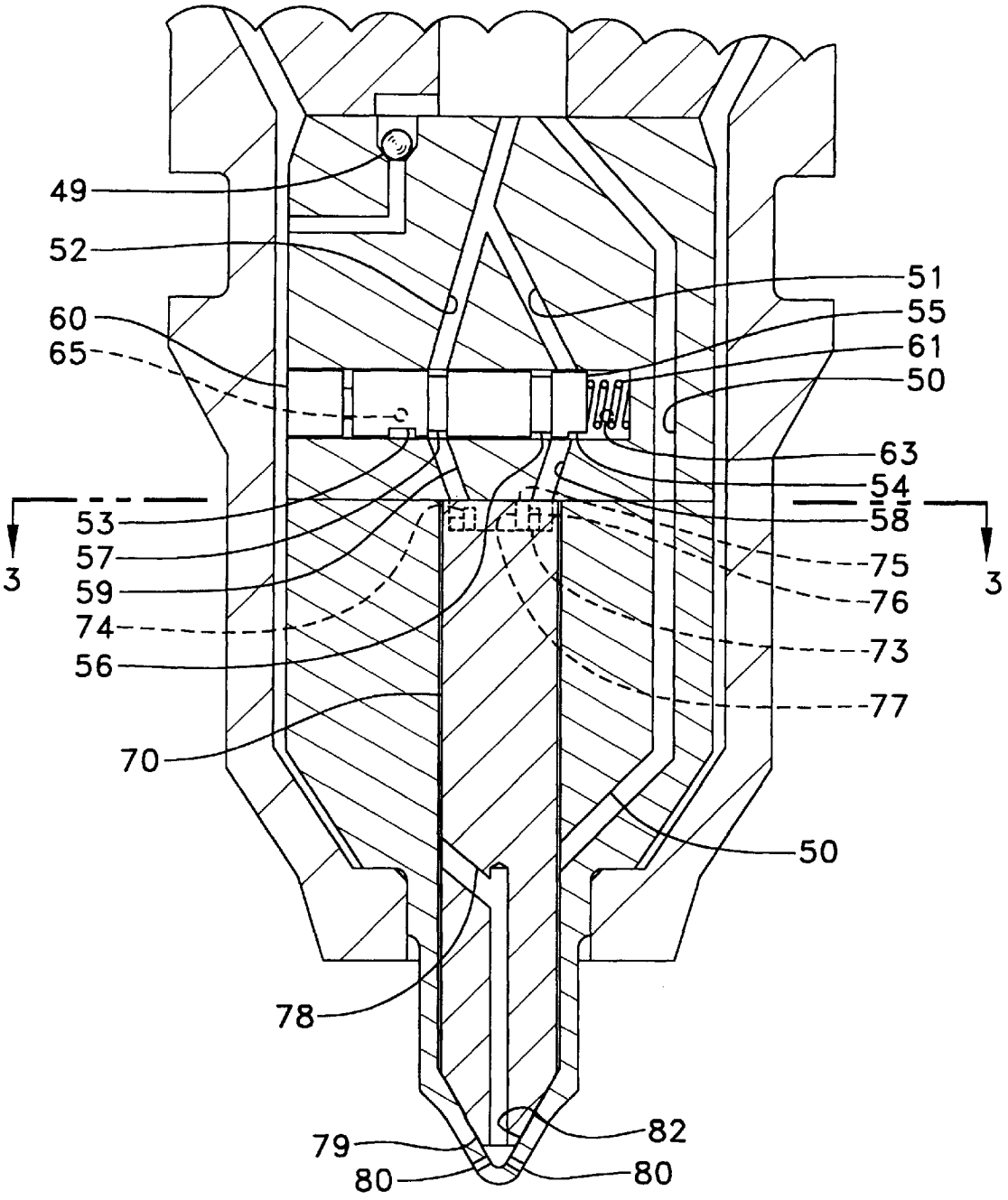
FIG. 2 is a partial diagrammatic representation of the nozzle portion of the fuel injector of FIG. 1.

Referring now in addition to FIG. 2, fuel pressurization chamber 48 is open to a high pressure passage 50, a first branch passage 51 and a second branch passage 52, all of which are defined by injector body 11. A spool valve member 55 is operably positioned in injector body 11 and is movable between a first position and a second position, and biased toward the second position by a biasing spring 61. A solenoid 60, or other suitable electric actuator, is operably connected to valve member 55, and can be activated to move valve member 55 toward its first position against the action of biasing spring 61. Valve member 55 preferably includes a first shoulder 53, a first annulus 56, a second shoulder 54 and a second annulus 57. When valve member 55 is in the first position, first annulus 56 is open to first branch passage 51 and second shoulder 54 closes an opening hydraulic pressure passage 58 to a low pressure drain 63, while second annulus 57 is closed from fluid communication with second branch passage 52 and first shoulder 53 opens a closing hydraulic pressure passage 59 to a low pressure drain 65. When valve member 55 is in the second position, as shown, first annulus 56 is closed from fluid communication with first branch passage 51 and second shoulder 54 opens opening hydraulic pressure passage 58 to low pressure drain 63. At the same time, second annulus 57 opens second branch passage 52 to closing hydraulic pressure passage 59.

Figure 3:
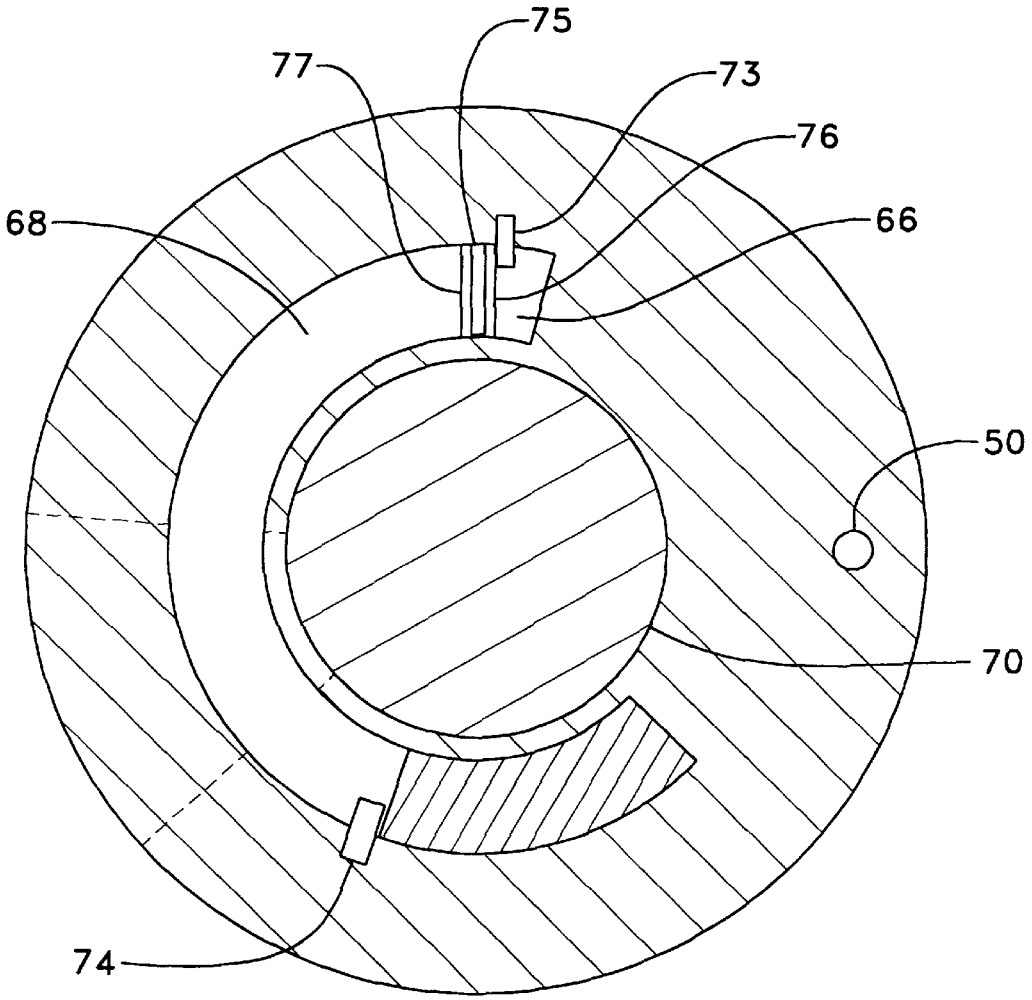
FIG. 3 is a sectioned view through the fuel injector of FIG. 1 as viewed along section lines 3—3 of FIG. 2.
Figure 4:
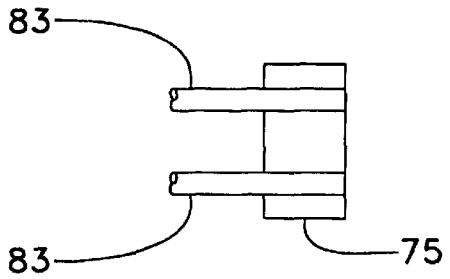
FIG. 4 is a diagrammatic representation of the paddle portion of the nozzle valve member of FIG. 2 according to the present invention.

Also positioned in injector body 11 is a nozzle valve member 70. Nozzle valve member 70 is rotatable between an open position in which high pressure passage 50 is open to a nozzle outlet 80 via an internal passage 78 defined by nozzle valve member 70, and a closed position in which high pressure passage 50 is blocked from fluid communication with nozzle outlet 80. Nozzle valve member 70 is biased by a biasing spring toward a downward position in which a needle valve tip 79 closes a nozzle valve seat 82. It should be appreciated that this biasing spring does not influence the rotation of nozzle valve member 70, but merely acts to force the same to close nozzle valve seat 82 to prevent leakage from nozzle outlet 80. Referring in addition to FIGS. 3 and 4, a portion of nozzle valve member 70 is preferably a paddle 75 that is secured by pins 83. Paddle 75 includes an opening hydraulic surface 76 exposed to hydraulic pressure in a control volume 66 and a closing hydraulic surface 77 exposed to hydraulic pressure in a nozzle control chamber 68. Control volume 66 and nozzle control chamber 68 are both defined in part by injector body 11 The hydraulic pressure forces that act on opening hydraulic surface 76 and closing hydraulic surface 77 to rotate nozzle valve member 70 between its open and closed positions are determined by the relative position of valve member 55.

When solenoid 60 is de-energized and valve member 55 is in its second position, as shown, second annulus 57 fluidly connects second branch passage 52 to closing hydraulic pressure passage 59, which is in fluid communication with nozzle control chamber 68. At the same time, second shoulder 54 opens low pressure drain 63 to opening hydraulic pressure passage 58, which is in fluid communication with control volume 66. When valve member 55 is in the position illustrated in FIGS. 2 and 3, high pressure fuel from second branch passage 52 can flow through closing hydraulic pressure passage 59 to act against closing hydraulic surface 77 in nozzle control chamber 68. At the same time, opening hydraulic surface 76 is exposed to low pressure in low pressure drain 63 via control volume 66. This combination of hydraulic forces acting on paddle 75 will cause nozzle valve member 70 to rotate until paddle 75 contacts a closing stop pin 73 that is preferably positioned and mounted as part of injector body 11. When nozzle valve member 70 is rotated to this position, internal passage 78 will be blocked from fluid communication with high pressure passage 50, thereby preventing fuel flow into the combustion space via nozzle outlet 80.

When solenoid 60 is energized, valve member 55 is moved toward its first position against the action of biasing spring 61. When valve member 55 is in this position, control volume 66 is open to first branch passage 51 via first annulus 56 and opening hydraulic pressure passage 58 while nozzle control chamber 68 is open to low pressure drain 65 via first shoulder 53 and closing hydraulic pressure passage 59. Closing hydraulic surface 77 is now exposed to low pressure in low pressure drain 65, while opening hydraulic surface 76 is exposed to high pressure in first branch passage 51. This imbalance of hydraulic forces acting on paddle 75 causes nozzle valve member 70 to rotate in the opposite direction until paddle 75 contacts opening stop pin 74 and nozzle valve member 70 is in its open position. Internal passage 78 is now open to high pressure passage 50 which fluidly connects the same to nozzle outlet 80.

INDUSTRIAL APPLICABILITY

Just prior to the start of an injection event, low pressure in fuel pressurization chamber 48 prevails, plunger 43 is in its retracted position, valve member 30 is biased to close valve seat 31 and actuation fluid cavity 34 is blocked from fluid communication with high pressure actuation fluid passage 25. Valve member 55 is in its second, biased position such that closing hydraulic pressure passage 59 and nozzle control chamber 68 are fluidly connected to second branch passage 52 via second annulus 57 and opening hydraulic pressure passage 58 and control volume 66 are fluidly connected to low pressure drain 63 via second shoulder 54. Nozzle valve member 70 is in its closed position to block high pressure passage 50 from fluid communication with nozzle outlet 80. The injection event is initiated by activation of electrical actuator 20, which causes armature 21 to pull poppet valve member 30 to open valve seat 31.

When poppet valve member 30 opens valve seat 31, high pressure actuation fluid flows into actuation fluid cavity 34 via high pressure actuation fluid passage 25. This high pressure fluid acts on hydraulic surface 41 of piston 40, causing the same to move downward against the action of biasing spring 45. As piston 40 advances, plunger 43 advances in a corresponding manner, causing check valve 49 to close and raising the pressure of the fuel within fuel pressurization chamber 48 and high pressure passage 50. However, because valve member 55 is still biased toward its second position by biasing spring 61, high pressure passage 50 remains closed from fluid communication with nozzle outlet 80.

When fuel spray is desired in the combustion chamber, a signal is sent to activate solenoid 60. Valve member 55 then advances toward its first position against the force of biasing spring 61. As valve member 55 advances toward this position, second annulus 57 moves out of contact with closing hydraulic pressure passage 59 thus closing it from fluid communication with second branch passage 52. Closing hydraulic pressure passage 59 is then open to a low pressure drain 65 via first shoulder 53. At the same time, first annulus 56 moves into contact with an opening hydraulic pressure passage 58, opening the same to fluid communication with first branch passage 51. Opening hydraulic surface 76 is now exposed to high pressure while closing hydraulic surface 77 is exposed to low pressure, causing nozzle valve member 70 to rotate toward opening stop 74. High pressure passage 50 is now fluidly connected to nozzle outlet 80 via internal passage 78, and fuel spray into the combustion chamber is commenced.

Shortly before the desired amount of fuel has been injected, a signal is sent to solenoid 60 to end the injection event. Current to solenoid 60 is then ended and valve member 55 begins to move toward its biased position under the action of biasing spring 61. As valve member 55 retracts, first annulus 56 moves out of contact with opening hydraulic pressure passage 58, closing the same from first branch passage 51, while low pressure drain 63 is opened to control volume 66 via opening hydraulic pressure passage 58 and second shoulder 54. At the same time, second annulus 57 moves into contact with closing hydraulic pressure passage 58, opening nozzle control chamber 68 to second branch passage 52. The hydraulic pressure imbalance acting on paddle 75 is now reversed such that closing hydraulic surface 77 is exposed to high pressure while opening hydraulic surface 76 is exposed to low pressure. This imbalance of hydraulic acting on paddle 75 causes nozzle valve member 70 to rotate toward its closed position until paddle 75 contacts closing stop 73. Internal passage 78 is now blocked from fluid communication with high pressure passage 50 and fuel spray into the combustion chamber is ended.

Between injection events, various components of injector 10 begin to reset themselves in preparation for the next injection event. A signal is sent to deactivate electrical actuator 20 and armature 21 moves poppet valve member 30 to close valve seat 31, ending the flow of high pressure actuation fluid into actuation fluid cavity 34 and opening the same to low pressure in low pressure reservoir 17. The downward movement of piston 40 and plunger 43 is ended due to the drop in hydraulic pressure acting on hydraulic pressure surface 41. Because actuation fluid cavity 34 is now open to low pressure reservoir 17 via low pressure passage 14 and low pressure drain 15, the strength of biasing spring 45 is sufficient to overcome the hydraulic force acting on hydraulic surface 41 and piston 40 and plunger 43 begin to return to their upward positions. The retracting movement of plunger 43 causes fuel from fuel inlet 19 to be pulled into fuel pressurization chamber 48 via fuel supply passage 47.

The present invention can increase the life of a fuel injector and decrease the likelihood of injector tip failure due to the elimination of nozzle valve member impact forces on the tip during injection events. Elimination of these impact forces on the tip can dramatically reduce the likelihood of injector tip failure, which could produce metal fragments that could destroy the entire engine. Because the present invention utilizes a needle check valve that rotates to open and close the nozzle outlet to pressurized fuel, rather than moving upward and downward, the thin metal of the tip is no longer subjected to nozzle valve member impact at the end of the injection event. Instead, a portion of the nozzle valve member impacts against an opening stop and a closing stop during rotation, both of which can be made from a more substantial piece of metal than the injector tip. Because the nozzle valve member is impacting a thicker area of the injector body, the likelihood of injector tip failure can be reduced.

While the present invention has been illustrated for use in only one variation of a hydraulically actuated fuel injector, those skilled in the art should appreciate that with minor modification, the present invention could find use in other models of the hydraulically actuated fuel injector. For instance, the present invention could be substituted into the hydraulically actuated fuel injector disclosed by Chen in U.S. Pat. No. 5,738,075. With minor modification to the fluid passageways of the Chen fuel injector, rotating nozzle valve member 70 could be substituted for the direct control nozzle valve member of Chen. Valve member 55 of the present invention could be modified to be controlled by biasing spring 61 and the hydraulic forces within the Chen injector and without the use of solenoid 60. In this manner, the Chen injector could benefit from the elimination of injector tip stress associated with nozzle valve member impact forces.

It should be understood that the above description is intended for illustrative purposes only, and is not intended to limit the scope of the present invention in any way. For instance, while the paddle has been shown as a portion of the nozzle valve member, it should be appreciated that it could instead be a separate component that is attached to the nozzle valve member. Further, while nozzle valve member has been shown biased downward to close the valve seat by a biasing spring, it should be appreciated that another mechanical biaser could be used. Additionally, a non-mechanical biaser, such as a hydraulic force could be substituted with minor modification to the present invention. Thus, those skilled in the art will appreciate the various modifications could be made to the disclosed embodiments without departing from the intended scope of the present invention, which is defined in terms of the claims set forth below.

What is claimed is:

1. A nozzle assembly comprising:

a nozzle body defining a high pressure passage, a nozzle outlet, and a valve seat adjacent said nozzle outlet;

a nozzle valve member being positioned in said nozzle body;

a biaser is operably positioned in said nozzle body to bias said nozzle valve member to close said valve seat; and said nozzle valve member being rotatable between a closed position in which said nozzle outlet is blocked to said high pressure passage and an open position in which said nozzle outlet is open to said high pressure passage.

2. The nozzle assembly of claim 1 wherein said nozzle valve member includes an opening hydraulic surface exposed to fluid pressure in a control volume, said control volume being defined in part by said nozzle body.

3. The nozzle assembly of claim 1 further comprising a low pressure drain connected to a low pressure fuel reservoir; and a fuel inlet connected to a source of medium pressure fuel.

4. The nozzle assembly of claim 1 wherein said high pressure passage is a high pressure fuel passage; and said nozzle valve member defines an internal passage that fluidly connects said high pressure fuel passage to said nozzle outlet when said nozzle valve member is in said open position.

5. The nozzle assembly of claim 1 further comprising a reciprocating pumping element; and a fuel pressurization chamber defined in part by said nozzle body and said reciprocating pumping element and fluidly connected to said high pressure passage.

6. The nozzle assembly of claim 1 wherein an electronically controlled valve member is included in said nozzle body;

said nozzle valve member includes an opening hydraulic surface; and said electronically controlled valve member is movable between a first position in which said opening hydraulic surface is exposed to said high pressure passage and a second position in which said opening hydraulic surface is exposed to a low pressure drain defined by said nozzle body.

7. A fuel injector comprising:

an injector body defining an actuation fluid inlet, an actuation fluid drain, a nozzle outlet and a high pressure passage;

a nozzle valve member being positioned in said injector body; and said nozzle valve member being rotatable between a closed position in which said nozzle outlet is blocked to said high pressure passage and an open position in which said nozzle outlet is open to said high pressure passage.

8. The fuel injector of claim 7 wherein said high pressure passage is a high pressure fuel passage; and said nozzle valve member defines an internal passage that fluidly connects said high pressure fuel passage to said nozzle outlet when said nozzle valve member is in said open position.

9. The fuel injector of claim 8 wherein said nozzle valve member includes an opening hydraulic surface exposed to fluid pressure in a control volume, said control volume being defined in part by said injector body.

10. The fuel injector of claim 9 wherein said nozzle valve member includes a closing hydraulic surface exposed to fluid pressure in a nozzle control chamber, said nozzle control chamber being defined in part by said injector body.

11. The fuel injector of claim 10 further comprising a reciprocating pumping element; and a fuel pressurization chamber defined in part by said injector body and said reciprocating pumping element and fluidly connected to said high pressure passage.

12. The fuel injector of claim 11 wherein said actuation fluid inlet is connected to a source of high pressure actuation fluid;

said actuation fluid drain is connected to a low pressure reservoir; and said injector body further defines a fuel inlet connected to a source of medium pressure fuel and a fuel drain connected to a low pressure fuel reservoir.

13. The fuel injector of claim 12 wherein said injector body defines a valve seat adjacent said nozzle outlet; and a biaser is operably positioned in said injector body to bias said nozzle valve member to close said valve seat.

14. A fuel injector comprising:

an injector body defining a high pressure passage and a nozzle outlet;

a direct control needle valve being positioned in said injector body and including a nozzle valve member; and said nozzle valve member being rotatable between a first position in which said nozzle outlet is closed to said high pressure passage and a second position in which said nozzle outlet is open to said high pressure passage.

15. The fuel injector of claim 14 wherein said nozzle valve member includes an opening hydraulic surface exposed to pressure in a control volume, said control volume being defined in part by said injector body.

16. The fuel injector of claim 15 wherein a needle control valve is positioned in said injector body; and said needle control valve is movable between a first position in which said control volume is closed to said high pressure passage and a second position in which said control volume is open to said high pressure passage.

17. The fuel injector of claim 14 wherein said nozzle valve member includes a closing hydraulic surface positioned in opposition to said opening hydraulic surface.

18. The fuel injector of claim 17 wherein an electronically controlled valve member is included in said injector body; and said electronically controlled valve member is movable between a first position in which said opening hydraulic surface is exposed to said high pressure passage and a second position in which said opening hydraulic surface is blocked from said high pressure passage.

19. The fuel injector of claim 18 wherein said electronically controlled valve member is a pilot valve member.

* * * * *